US005381913A

United States Patent [19]

Peeters

[11] Patent Number: 5,381,913

[45] Date of Patent: Jan. 17, 1995

[54] CAP WITH AN INDUCTION SEAL CLOSURE

[75] Inventor: Dirk Peeters, Mortsel, Belgium

[73] Assignee: Agfa-Gevaert N. V., Mortsel, Belgium

[21] Appl. No.: 28,083

[22] Filed: Mar. 8, 1993

[30] Foreign Application Priority Data

Mar. 25, 1992 [EP] European Pat. Off. ..... 92200853.7

[51] Int. Cl.[6] ..... B65D 55/02

[52] U.S. Cl. ..... 215/232; 215/347; 428/35.7; 428/347

[58] Field of Search ..... 215/347, 346, 232, 349; 428/35.7, 36.92, 354, 355, 338

[56] References Cited

U.S. PATENT DOCUMENTS 4,452,842 6/1984 Borges et al. ..... 215/347
4,576,297 3/1986 Larson ..... 215/347
4,596,338 6/1986 Yousif ..... 215/347
4,666,052 5/1987 Ou-Yang ..... 215/347
4,930,646 6/1990 Emslander ..... 215/347
4,935,273 6/1990 Ou-Yang ..... 215/347

*Primary Examiner*—Joseph Man-Fu Moy
*Attorney, Agent, or Firm*—William J. Daniel

[57] ABSTRACT

A cap with an induction seal closure for sealing the pouring opening of a container, the induction seal closure comprising a polymer sealing layer (27) capable of being heat-sealed to the top surface of the pouring opening of the container, an aluminum foil (22) for heat-sealing said sealing layer by inductive heating of the aluminum, a first releasing layer (25) between said aluminum foil and said sealing layer and a second releasing layer (21) between said aluminum foil and the top wall of said cap, the releasing power of said second releasing layer (21) being greater than that of said first one (25) so that upon removal of the cap from a sealed container the aluminum foil (22) remains adherant to the sealed container instead of to the cap while yet being easily peelable from the container as a consequence of the presence of said first releasing layer (25).

10 Claims, 1 Drawing Sheet

CAP WITH AN INDUCTION SEAL CLOSURE

BACKGROUND OF THE INVENTION

1. Field of the Invention

The present invention relates to a cap with an induction seal closure for sealing the pouring opening of a container, and to an injection-moulded screw cap in particular.

2. Description of the Prior Art

Injection-moulded screw caps are commonly used for sealing bottles or jerricans. The main functions that screw caps are requried to perform are keeping the bottle or jerrican closed until the contents must be used, and offering the possibility to open the bottle without difficulty and to re-close it properly with ease when only part of the contents is used at a time.

A particular form of screw closure is known which is devised to operate in conjunction with containers that are initially sealed by an induction-sealed membrane. Such membranes typically consist of a foil of aluminium bonded to a thermoplastic layer such as a layer of LDPE (low-density polyethylene), the thermoplastic layer being sealed to the opening of a container by its melting caused by inductive heating of the aluminium foil. This seal insures the user that he is the first user of the container and it also forms a safe leak-tight closure of the container during all the phases that precede its first use, such as manipulations in a warehouse, transport by road or by air, etc. Finally, this seal allows the container to be positioned in apparatus in which the container is used upside down, and emptying of the container starts by perforation of the membrane as the container becomes located on its seat.

A disadvantage of an induction seal closure is that removal of the closure cap from the mouth of the container can leave fragments of the aluminium-LDPE laminate adhered to the rim of the container mouth. This hampers easy recycling of the container since fragments of aluminium in the recycled plastic precludes a homogeneous extrusion blow-moulding of products from the recycled plastic.

It has been proposed to provide the induction seal closure with a releasing layer which causes a reduction of the bonding strength between the aluminium foil and the thermoplastic sealing layer after the sealing has been carried out, so that the initial unscrewing of the cap from the container causes the aluminium foil to become detached from the container and to remain in the screw cap. The problems with recycling the empty container are solved in this way but now the aluminium remains within the cap and so forms a problem for recycling the screw caps.

SUMMARY OF THE INVENTION

OBJECTS OF THE INVENTION

It is an object of the present invention to provide a cap with an improved induction seal closure for sealing the pouring opening of a container, which offers the opportunity for easy separation of the aluminium foil from the container as well as from the cap so that recycling of both of these components is free of problems.

The invention aims in particular at plastic containers with plastic caps which, when empty and reclosed, can be entirely recycled.

STATEMENT OF THE INVENTION

A cap with an induction seal closure for sealing the pouring opening of a container, the induction seal closure comprising a polymer sealing layer capable of being heat-sealed to the top surface of the pouring opening of the container, an aluminium foil for heat-sealing said sealing layer by inductive heating of the aluminium, a first releasing layer between said aluminium foil and said sealing layer and a second releasing layer between said aluminium foil and the inner surface of the top wall of said cap, the releasing power of the second releasing layer being greater than that of the first one so that upon removal of the cap from a sealed container the aluminium foil remains adherant to the sealed container instead of to the cap while yet being easily peelable from the container as a consequence of the presence of the first releasing layer.

The term "releasing layer" as used in the present specification stands for an adhesive layer with limited adhesive power and which is in fact intended to enable an easy separation of two layers held together thereby, without or without substantial destruction of such layers. The term "adhesive" means the broad range of bonding agents that include synthetic resins as well as glues.

The peeling of the aluminium foil from the sealed container is preferably done by hand, and the aluminium foil is then preferably discarded in a receptacle separate from common waste-paper baskets and the like.

The term "container" as used in the present specification encompasses in particular plastic bottles, cans, or jerricans for holding a liquid- or powder-like product, but said term does not exclude glass or other recipients that lend themselves to recycling.

The invention has been developed for photographic processing liquids in particular but it is clear that the subject of the invention may be used in any other field outside of photography where containers with induction sealed closures are used and their recycling under optimum conditions is desired.

Suitable embodiments of the invention are as follows.

The difference in releasing power of both releasing layers becomes functional only after inductive sealing.

The releasing layers are constituted by the combination of a paper and a wax layer.

A resilient polymeric foam layer with closed cell structure is provided between the second releasing layer and the innerside of the top wall of the cap.

A polyethylene terephthalate layer forms a laminate with the sealing layer, and the sealing layer is made of LDPE.

BRIEF DESCRIPTION OF THE DRAWINGS

The invention will be described hereinafter by way of example with reference to the accompanying drawings wherein:

Referring to FIG. 1, a screw cap 10 made of high-density polyethylene or the like has a cylindrical skirt portion 11 and a flat top or end wall 12. The cap skirt is at the inside provided with an inner screw thread 13 for co-operation with an outer screw thread 14 on the pouring neck 15 of a container, not shown, and on its outside with axial ribs 16 for gripping by the operator's fingers. The exterior of the top wall of the cap is provided with a peripheral rim 16 and with a cutting tooth 17 which can be used to cut the sealing foil of the container in the inverted position of the screw cap. More details about suitable cutting teeth on screw caps can be found in BE-A-867,503 and in Research Disclosure, November 1981, subject 21110.

Figure 1:
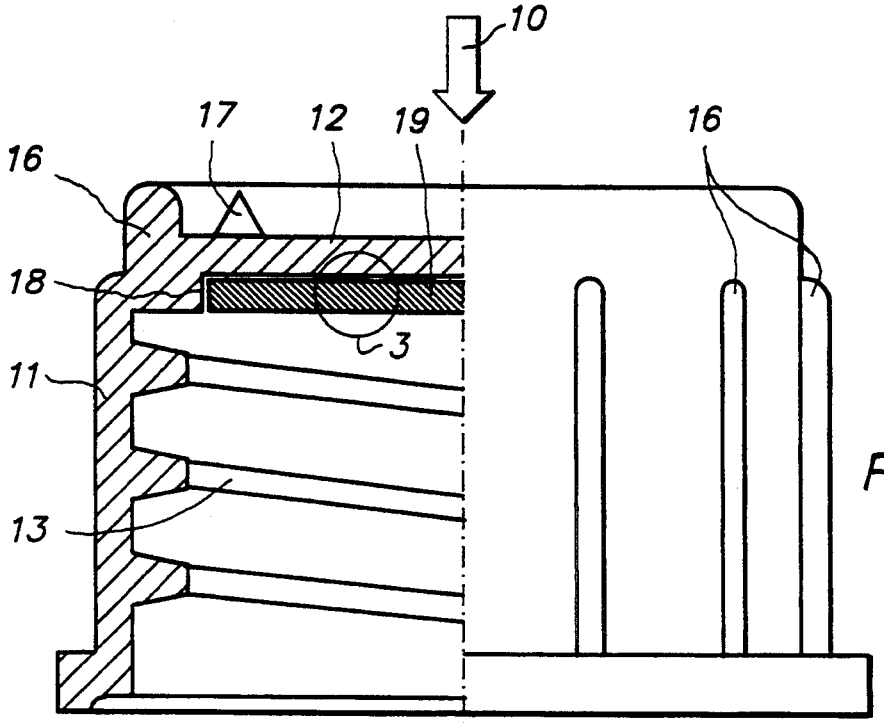
FIG. 1 is a side view of one embodiment of a screw cap according to the invention, partly broken away.
Figure 2:
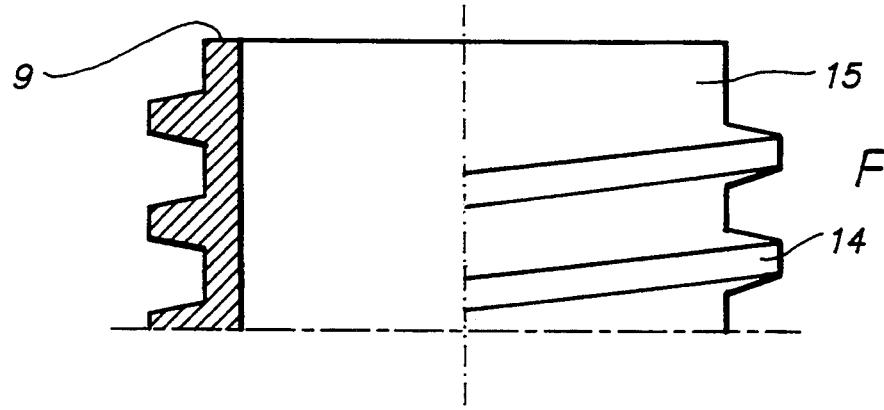
FIG. 2 is a side view of the neck of a container.
Figure 3:
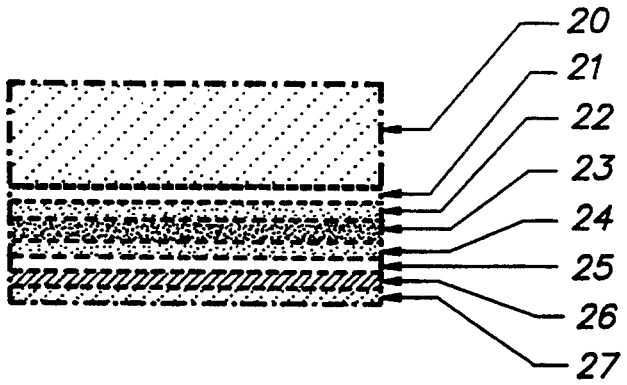
FIG. 3 is an enlarged view of detail 3 of FIG. 1.

The screw cap is provided at the inside with a circular cavity 18 into which an induction seal closure 19 is located, the composition of which is illustrated in detail in FIG. 3, which is an enlarged view of the encircled portion 3 of FIG. 1.

The inductive seal closure comprises a layer 20 of low-density polyethylene foam with closed cell structure, a layer 21 of wax, a layer 22 of paper, a foil of aluminium 23, a layer of paper 24, a layer of wax 25, a layer of polyethylene terephthalate 26 and a LDPE layer 27. Layers 20 and 22, and 24 and 26 are bonded to each other through the wax layers 21 and 25 respectively, whereas the two paper layers 22 and 24 are bonded to the aluminium foil by a suitable adhesive, and layers 26 and 27 are heat-laminated onto each other.

The purpose of polyethylene terephthalate layer 26 is to provide a vapour-tight closure, layer 27 ensuring the firm bonding of layer 26 to the container opening.

Foam layer 20 has on top a dot of hot-melt adhesive (not shown) by which it is fitted to the inside surface of top wall 12 of the cap. According to an alternative embodiment, the induction seal closure 19 may be clampfitted in cavity 18 of the cap. Foam layer 20 may occasionally be provided with a suitable layer at its lower surface to promote the release of the wax layer 21 upon heating.

The adhesive power of the two wax layers 21 and 25 is sufficiently high to maintain good bonding contact between adjacent layers. Thus, the seal closure can be manufactured in a usual way by bringing the different constituent layers in bonding contact with each other, and then punching from a roll of such material discs 19 as shown that can be mounted in the caps.

The adhesive power of the two wax layers is greatly reduced as the layers become heated by the inductive heating of the aluminium foil. As a matter of fact, the change-over from the solid to the molten state causes the wax to become absorbed by the paper layers, whereby said two wax layers will allow easy separation of the layers kept together by them.

The operation of closure 19 is as follows.

A screw cap as illustrated in Fig. I being tightly screwed on a filled plastic container, the aluminium foil 22 is inductively heated as known in the art to heat layer 27 by heat-conduction to a degree such that said layer melts and becomes united with the annular top surface 9 of neck 15 of the container. Heating of the aluminium foil causes absorption of the wax layers as described hereinbefore, it being understood that the releasing power of wax layer 21 is larger than that of wax 1 layer 25.

If the screw cap is removed for the first time, a seal closure formed by layers 21 to 27 remains on the neck of the container, whereas foam layer 20 remains in the cap.

The operator then peels off the laminate comprising layers 21 to 25 from the container, and then opens the container, e.g. by using tooth 17 of inverted cap 10 as a cutting tool to remove the remaining seal formed by layers 26 and 27.

If the container is not completely emptied and must be reclosed, foam layer 20 forms a liquid-tight seal between cap 10 and surface 9 of neck 15 of the container.

The described difference in releasing power of the described two releasing layers can be obtained in different ways.

Waxes with different hardness can be used for layers 21 and 25. The wax used for the first releasing layer 25 can have a higher melting temperature than the wax of the second releasing layer 21. Alternatively, different layer thicknesses can be used for the wax layers. Also, paper layers with different absorbing power can be used.

The glue is not necessarily be wax, but also plant resins, bitumen and other naturally occurring substances can be used.

Further, the releasing layers need not necessarily be a combination of a paper and a wax or more generally, a glue layer, but may also be polymeric layers with appropriate releasing properties.

The releasing layers need not necessarily have a continuous structure but can also show a discontinuous structure, e.g. in the form of screen dots or the like. Differences in the screen pattern can determine the difference in releasing power.

Examples of polymeric adhesive layers with discontinuous characteristics are disclosed in WO 85/04602 relating to "Removable labels".

Finally, the invention is not limited to screw caps but encompasses snap-on covers as well.

I claim:

1. A cap having a skirt and a top wall with an interior induction seal closure for sealing the pouring mouth of a container closed by the cap, wherein the induction seal closure comprises a heat-sealable polymer sealing layer capable of being heat-sealed to the top edge of the mouth, an aluminum foil layer for heat-sealing said sealing layer by inductive heating of the aluminum, a first releasing layer between said aluminum foil layer and said sealing layer and a second releasing layer separating said aluminum foil layer from the top wall of the cap, the releasing power of said second releasing layer being greater than that of said first layer so that upon removal of the cap from a sealed container, the aluminum foil layer remains adhered to the sealed container instead of to the cap while yet being easily peelable from the container as a consequence of the presence of said first releasing layer.

2. A cap according to claim 1, which is a plastic screw cap.

3. A cap according to claim 1, wherein the difference in releasing power of both releasing layers is obtained only after the inductive sealing of the closure.

4. A cap according to claim 3, wherein said releasing layers are constituted by the combination of a paper and a wax layer.

5. A cap according to claim 4, wherein the melting temperature of the wax of the first releasing layer is higher than the melting temperature of the wax of the second releasing layer.

6. A cap according to claim 1, wherein both releasing layers have a screen pattern and the difference in releasing power of both layers is based on differences in their screen pattern.

7. A cap according to claim 1, wherein a resilient layer is provided between the second releasing layer and the innnerside of the top wall of the cap.

8. A cap according to claim 7, wherein said resilient layer is a polymeric foam with closed cell structure.

9. A cap according to claim 1, wherein a polyethylene terephthalate layer forms a laminate with said sealing layer.

10. A cap according to claim 1, wherein the sealing layer is made of LDPE.

* * * * *